US007255330B2

(12) United States Patent
Lutter et al.

(10) Patent No.: US 7,255,330 B2
(45) Date of Patent: Aug. 14, 2007

(54) FIELD ADJUSTABLE BRIDGE CRANE BLOCK

(75) Inventors: Ernest E. Lutter, Sand Springs, OK (US); Paul A. Boeckman, Tulsa, OK (US); Alan C. Doughty, Tulsa, OK (US)

(73) Assignee: The Crosby Group, Inc., Tulsa, OK (US)

( * ) Notice: Subject to any disclaimer, the term of this patent is extended or adjusted under 35 U.S.C. 154(b) by 608 days.

(21) Appl. No.: 10/864,002

(22) Filed: Jun. 9, 2004

(65) Prior Publication Data

US 2005/0274936 A1 Dec. 15, 2005

(51) Int. Cl.
*B66D 3/08* (2006.01)

(52) U.S. Cl. ..... 254/393; 254/416

(58) Field of Classification Search ..... 254/393, 254/402, 404, 405, 416
See application file for complete search history.

(56) References Cited

U.S. PATENT DOCUMENTS 1,791,008 A * 2/1931 Statler et al. ..... 254/404
2,535,915 A * 12/1950 Gorrell ..... 184/6
2,650,403 A * 9/1953 Taylor, Jr. et al. ..... 294/82.2
3,936,034 A 2/1976 Larralde ..... 254/188
4,098,492 A 7/1978 Wilkinson ..... 254/189
4,489,526 A 12/1984 Cummins ..... 52/125.6
4,842,250 A 6/1989 Willis et al. ..... 254/337
5,004,108 A 4/1991 Van Ketel ..... 212/255
5,603,420 A 2/1997 Swanson ..... 212/274
5,950,953 A 9/1999 Baugh et al. ..... 242/397.3
6,401,370 B1 6/2002 Blom et al. ..... 37/396
6,405,833 B1 * 6/2002 Baranda et al. ..... 187/254
6,408,956 B1 6/2002 Morris et al. ..... 175/113

* cited by examiner

*Primary Examiner*—Emmanuel M Marcelo
(74) *Attorney, Agent, or Firm*—Head, Johnson & Kachigian

(57) ABSTRACT

A field adjustable block for use with a bridge crane having a rotating cylindrical drum for rope. The block includes a cylindrical center pin having a key way recess parallel to an axis of the center pin. An inner side plate has an opening therethrough and an extending key receivable in the key way recess to prevent rotation of the inner side plate. Multiple sheaves are receivable over the center pin. At least one toroidal spacer is receivable over the center pin. A lock washer has an inwardly extending key receivable in the key way recess of the center pin and has a plurality of radially extending tabs. A nut has at least one notch to receive one of the extending tabs therein. An outer side plate is removably attached to the inner side plate by fasteners.

14 Claims, 5 Drawing Sheets

FIELD ADJUSTABLE BRIDGE CRANE BLOCK

BACKGROUND OF THE INVENTION

1. Field of the Invention

The present invention is directed to a block for use with a bridge crane wherein the block is adjustable in the field to adjust the lateral spacing of the sheaves in order to optimize the system geometry for the particular application and to minimize wear on the components.

2. Prior Art

Bridge cranes and accompanying blocks operate on the principle of mechanical advantage which is obtained through the use of multiple sheaves or pulleys. The greater the number of sheaves, the greater the load that can be lifted for a given line pull. This allows for crane designs that use relatively smaller winches to lift relatively heavier loads. The sheaves are attached to the load via a load block and a fitting.

Bridge cranes are often used in applications where the bridge crane will ride on a beam or beams and a block is suspended from wire line extending from the bridge crane.

The load is raised or lowered as a rotating drum on the bridge crane pulls in or lets out wire rope. As the rope moves, the block is either raised or lowered away from the drum assembly. The change in the geometry due to the raising and lowering of the load causes the so-called "fleet angle" to change. This fleet angle can become excessive which will cause increased wire rope wear and increased wear on the sheave flange. The wear in the system is of concern as it may ultimately decrease the strength of the rope and reduce the desired and necessary design factor of the rope.

Standard bridge crane systems often specify particular block geometry in order to minimize the amount of rope and sheave wear along the full range of block travel. This results in the maximum rope and sheave wear at the lowest and highest positions of the block. Special applications may result in the block operating primarily at or near the highest or the lowest position. For example, in lifting tall pieces, the block may operate primarily at its highest position. Conversely, in lifting shorter pieces, the block may operate primarily at its lowest position. While it would be possible to replace the entire block including sheaves, depending on the particular application, this is time consuming and requires an inventory of different blocks.

Accordingly, for a given set of lifting height parameters, the optimum sheave spacing may be identified.

Also in the past, other types of block arrangements have been utilized. For example, Swanson (U.S. Pat. No. 5,603,420) discloses floating sheaves in FIGS. 11 through 14 which are movable along the shafts. Oftentimes, however, the floating sheaves are not suitable for harsh environments associated with bridge crane activity.

Morris et al. (U.S. Pat. No. 6,408,956) discloses movable sheaves. The movable sheaves slide to reduce the fleet angle in the system and reduce the amount of moment applied to the piston and drill string.

Larralde (U.S. Pat. No. 3,936,034) discloses a block with multiple sheaves having a mechanism to minimize the fleet angle of the line by varying the angle of the crown block sheaves. The adjustment to the spacing of the wire line is not obtained by moving the sheaves but by moving the ropes away from a rotational center to unused sheaves in order to try to balance the moments generated in the system.

Additionally in the past, various designs have provided to ease reeving of lines on the sheaves. Wilkinson (U.S. Pat. No. 4,098,492) discloses sheaves having removable guards 24 and 25 to quickly reeve the line.

Accordingly, it would be desirable to provide a replacement bridge crane block wherein the spacing between the sheaves is adjustable in the field.

It would also be desirable to provide a field adjustable replacement bridge crane block having a center pin which is long enough to accommodate various chosen spacing widths between the sheaves.

It would also be desirable to provide a field adjustable replacement bridge crane block having a replaceable center pin for selected spacing of the sheaves.

It would also be desirable to provide a field adjustable replacement bridge crane block having a nut locking mechanism to lock a nut onto the center pin.

It would also be desirable to provide a field adjustable replacement bridge crane block having a sheave housing plate which is locked against rotation.

It would also be advantageous to provide a field adjustable replacement bridge crane block having a removable outer housing plate for access to the sheave.

SUMMARY OF THE INVENTION

The present invention is directed to a field adjustable block for use with a bridge crane. The block includes at least a pair of sheaves and will operate in different configurations with multiple sheaves. Each sheave is configured in a sheave assembly.

The block includes a cylindrical center pin which is replaceable with pins of different lengths depending on the desired configuration. Suspended from the center pin is a fitting assembly. In one preferred embodiment, the fitting includes a case having a cylindrical opening through which is received the cylindrical center pin. Suspended from the case is a fitting such as, but not limited to, a hook.

The sheave assemblies are spaced equidistantly from the center of the block. The sheave spacing may take alternate configurations through the field adjustment ability of the present invention.

The center pin includes a key way slot or recess which is recessed into the circumference of the center pin. The key way slot or recess is parallel to an axis of the center pin. An inner side plate has a circular opening through which is received the center pin. The inner side plate also includes an extending key extending into the opening. The combination of the extending key and the key way recess prevent the inner plate from rotating.

A sheave has a central opening with a circumferential groove to receive wire rope therein.

A plurality of toroidal spacers are employed either between the inner plate and the sheave or alternatively, outside the sheave.

Spaced from the sheave is a lock washer which fits over the cylindrical center pin and has an inwardly extending key receivable in the key way recess of the center pin. Additionally, the lock washer includes a plurality of radially extending tabs. Finally, a nut having internal threads is received on the threaded end of the center pin.

Once the entire assembly is configured, the nut is threaded onto the end of the center pin until tight. Thereafter, one of the radially extending tabs is bent over into a notch in the nut. Finally, an outer side plate encloses the toroidal spacers, the lock washer and the nut. The outer plate is removably attached to the inner plate by a series of fasteners.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
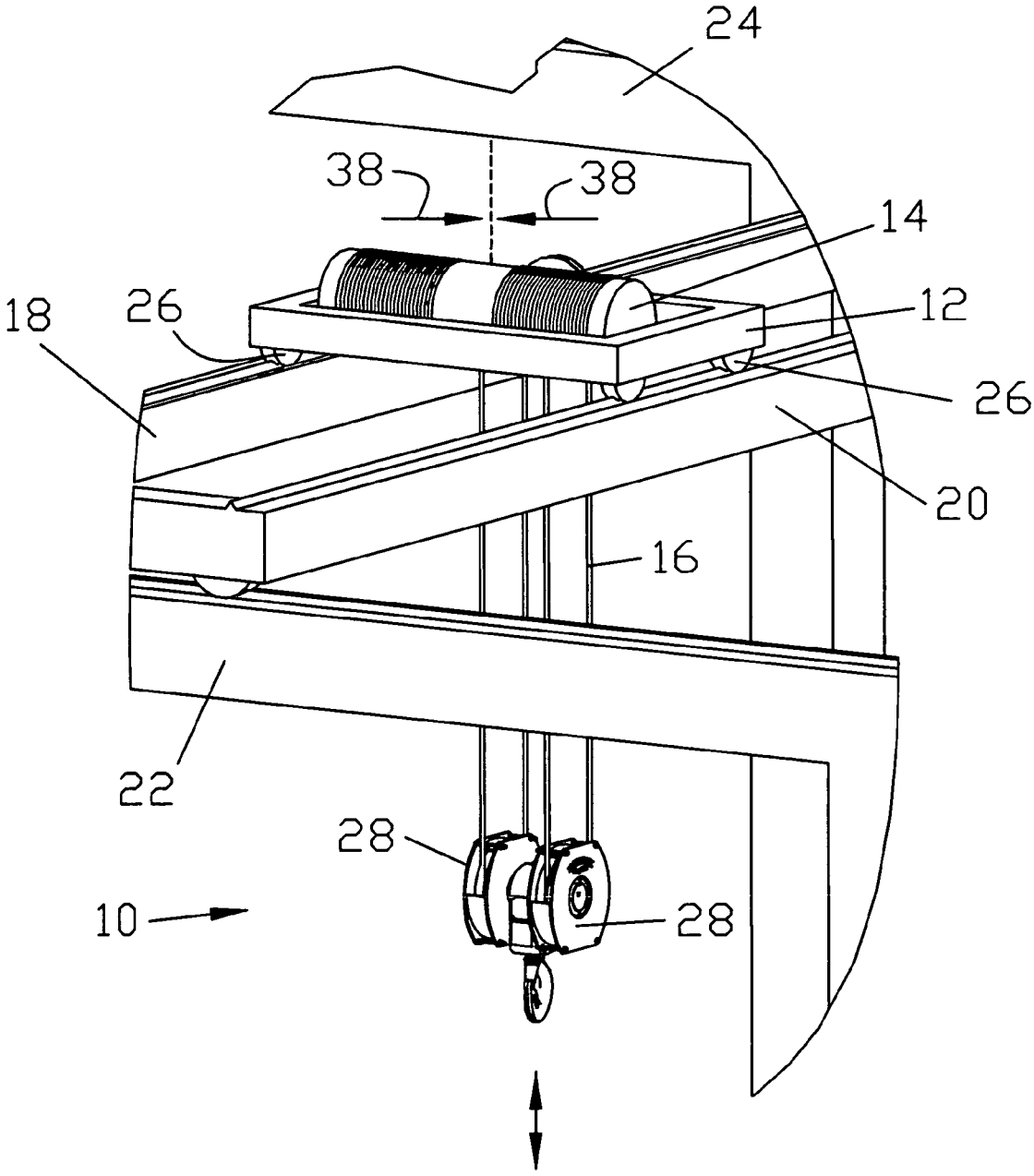
FIG. 1 illustrates a partial, perspective view of a bridge crane in operation with a field adjustable bridge crane block constructed in accordance with the present invention.

Referring to the drawings in detail, FIG. 1 illustrates a perspective view of a bridge crane in operation with a field adjustable block 10 constructed in accordance with the present invention. The bridge crane 12 includes a rotating cylindrical drum 14 which is capable of powered rotation to wind or unwind wire rope 16 thereon. In one standard configuration, the wire rope 16 winds onto the drum toward the center as shown by arrows 38. Accordingly, the fleet angle will vary depending on the position of the block 10 to the drum. The bridge crane 12 will ride on a beam or beams 18 and 20 which, in turn, may ride on beams 22 and 24. The bridge crane 12 moves on the beams 18 and 20 via wheels 26 or other mechanism.

The present embodiment is described with a block 10 having a pair of sheaves although it will be understood that the invention may operate in different configurations with multiple sheaves such as four or six sheaves. Each sheave is configured in a sheave assembly 28.

Figure 2:
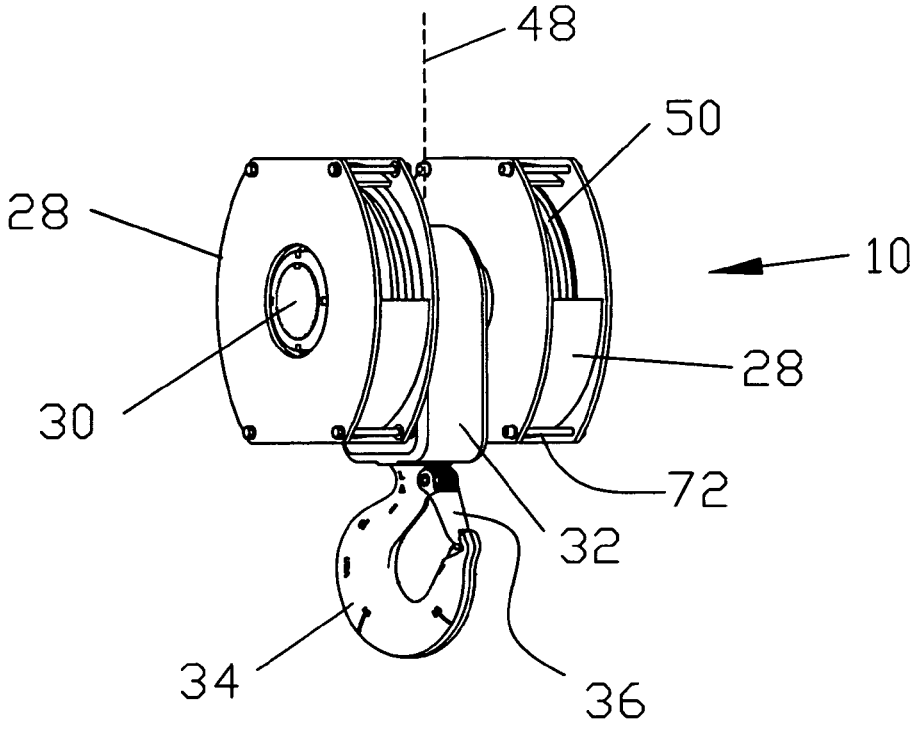
FIG. 2 illustrates a perspective view of the bridge crane block as shown in FIG. 1.

FIG. 2 illustrates a perspective view of a bridge crane block 10 with the wire rope 16 removed. The block 10 includes a cylindrical central pin 30 which is parallel to the cylindrical drum and perpendicular to the sheaves. The center pin is replaceable with pins of different lengths depending on the configuration.

Suspended from the center pin is a fitting assembly. The fitting includes a case 32 having a cylindrical opening (not visible in FIG. 1 or 2) through which is received the cylindrical center pin 30. Suspended from the case 32 is a fitting 36.

In the present embodiment, the fitting is a hook 34 although various other fittings may be utilized within the spirit and scope of this present invention including shackles, rings, and eyebolts. The hook may be attached to the case 32 through a swivel (not visible) and may take various configurations including a latch 36.

The sheave assemblies 28 are spaced equidistantly from the center of the block illustrated by dashed line 48.

FIGS. 3, 4, 5 and 6 illustrate exploded views of the block 10 in alternate configurations of sheave spacing that the block 10 may take through the field adjustment ability of the present invention. In each configuration, one sheave assembly 28 is shown exploded while the other sheave assembly is mounted on the center pin.

The center pin 30 includes a key way slot or recess 40 which is recessed into the circumference and which is parallel to an axis of the center pin. An inner side plate 42 has a circular opening 44 through which is received the center pin. The inner side plate 42 also includes an extending key extending into the opening 44. The combination of the extending key 46 and the key way recess 40 prevent the inner plate 42 from rotating.

A sheave 50 has a central opening with a circumferential groove to receive the wire rope 16 therein. The sheave 50 may optionally include a bearing or bearings 52 juxtaposed between the sheave 50 and the center pin.

A plurality of toroidal spacers 54 are employed. Depending on the desired lateral spacing of the sheave, the toroidal spacers 54 will be employed between the inner plate 42 and the sheave 50 or alternatively, outside the sheave 50.

Spaced from the sheave 50 is a lock washer 58. The lock washer 58 fits over the cylindrical center pin 30 and has an inwardly extending key 60 receivable in the key way recess 40 of the center pin. Additionally, the lock washer 58 includes a plurality of radially extending tabs 62. Finally, a nut 64 having internal threads is received on a threaded end of the center pin 30.

Figure 11:
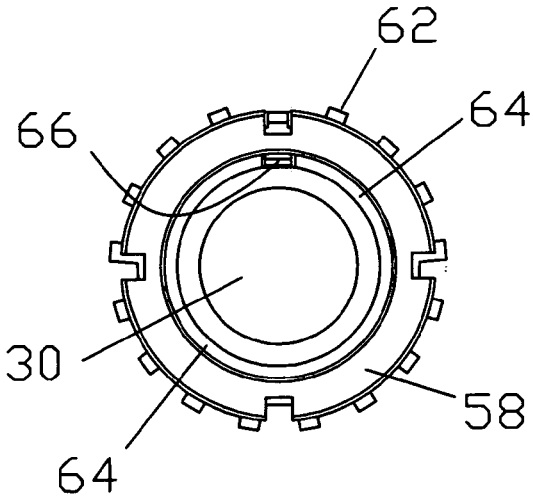
FIG. 11 illustrates a partial end view of a nut locking mechanism for the bridge crane block shown in FIG. 7.

As best seen in FIG. 11, once the entire assembly is configured, the nut 64 is threaded onto the end of the center pin until tight. Thereafter, one of the radially extending tabs 62 is bent over into a notch 66 in the nut. Finally, an outer side plate 70 encloses the toroidal spacers 54, lock washer 58 and nut. The outer plate is removably attached to the inner plate by a series of fasteners 72. The outer plate may be removed from the sheave assembly without disassembling the block in order to reeve or unreeve the wire rope.

Figure 3:
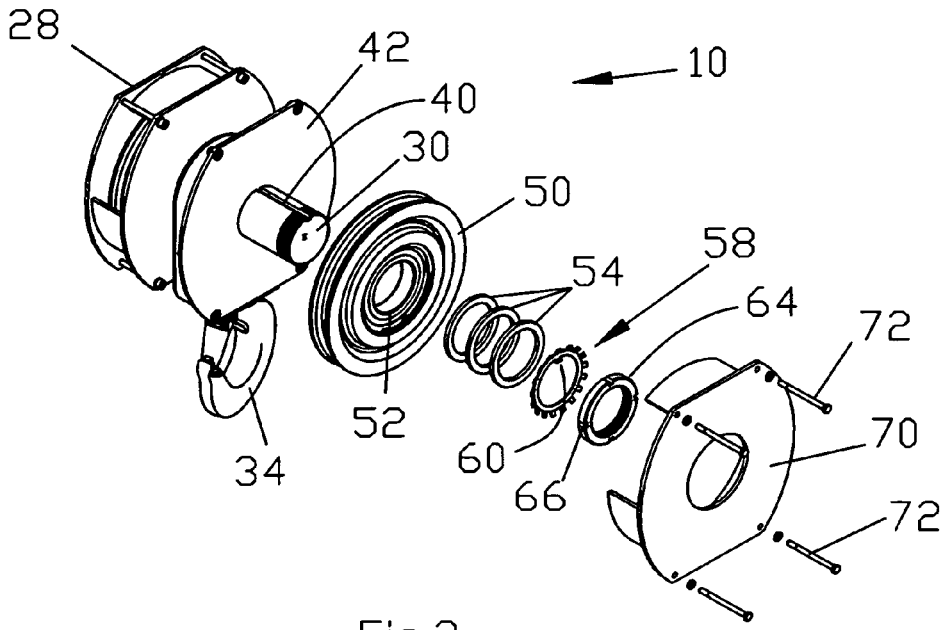
FIGS. 3, 4, 5 and 6 illustrate exploded views of the bridge crane block shown in FIGS. 1 and 2 arranged in alternate configurations for desired spacing.
Figure 4:
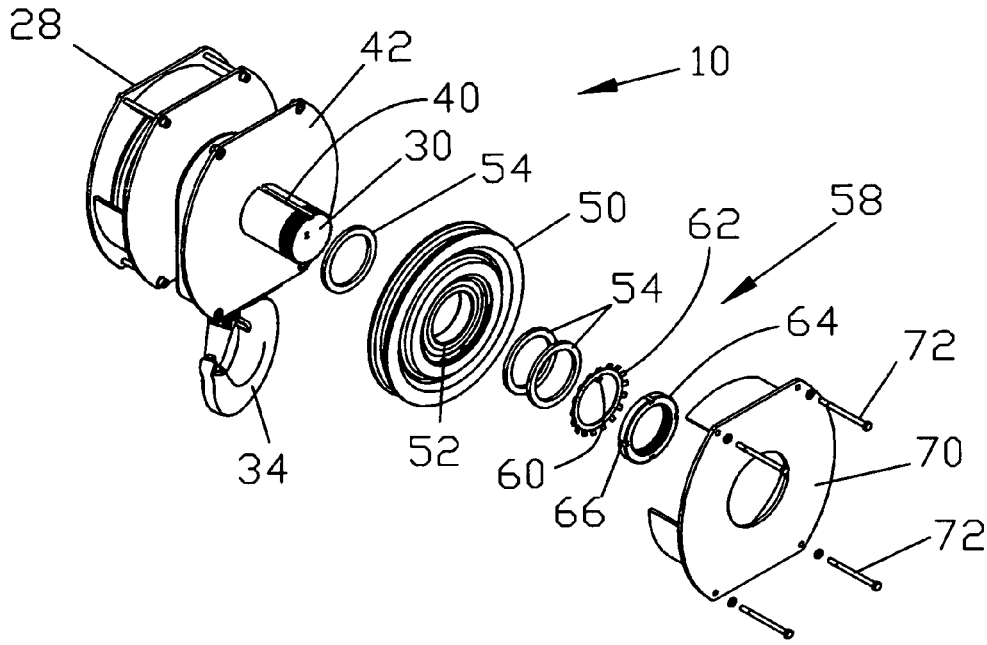
Figure 5:
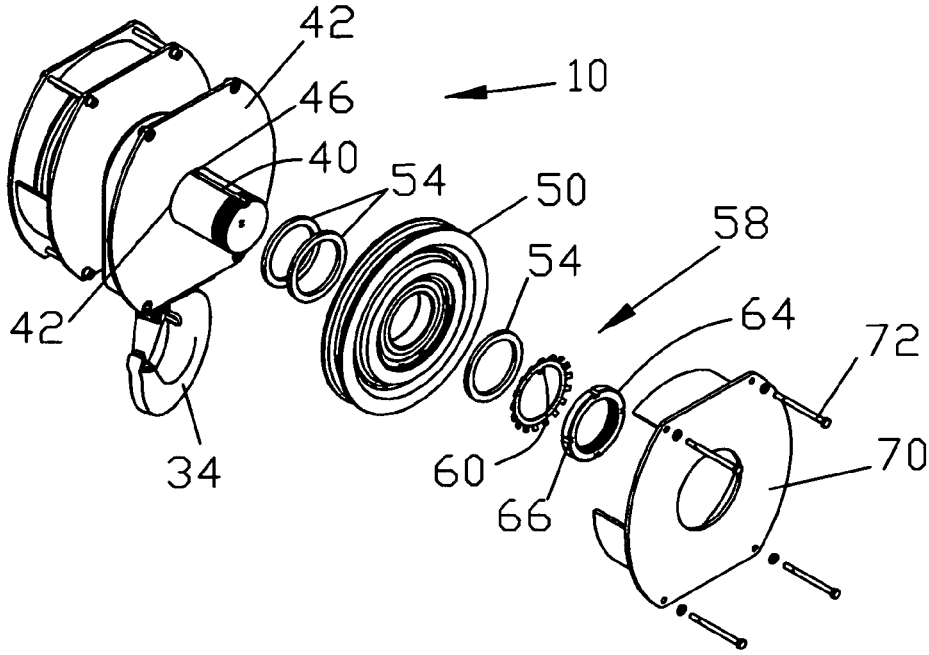
Figure 6:
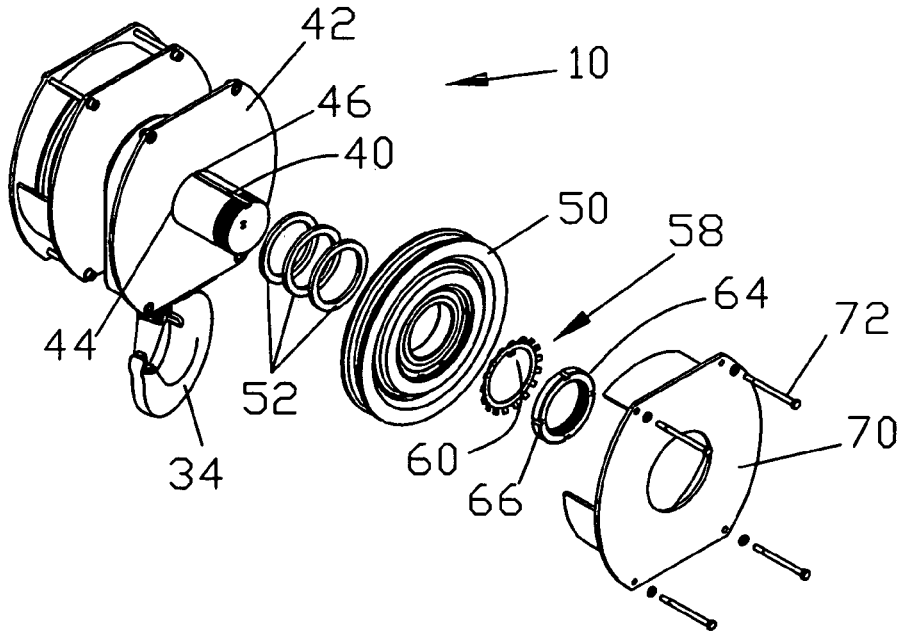
Figures 7, 8, 9, 10:
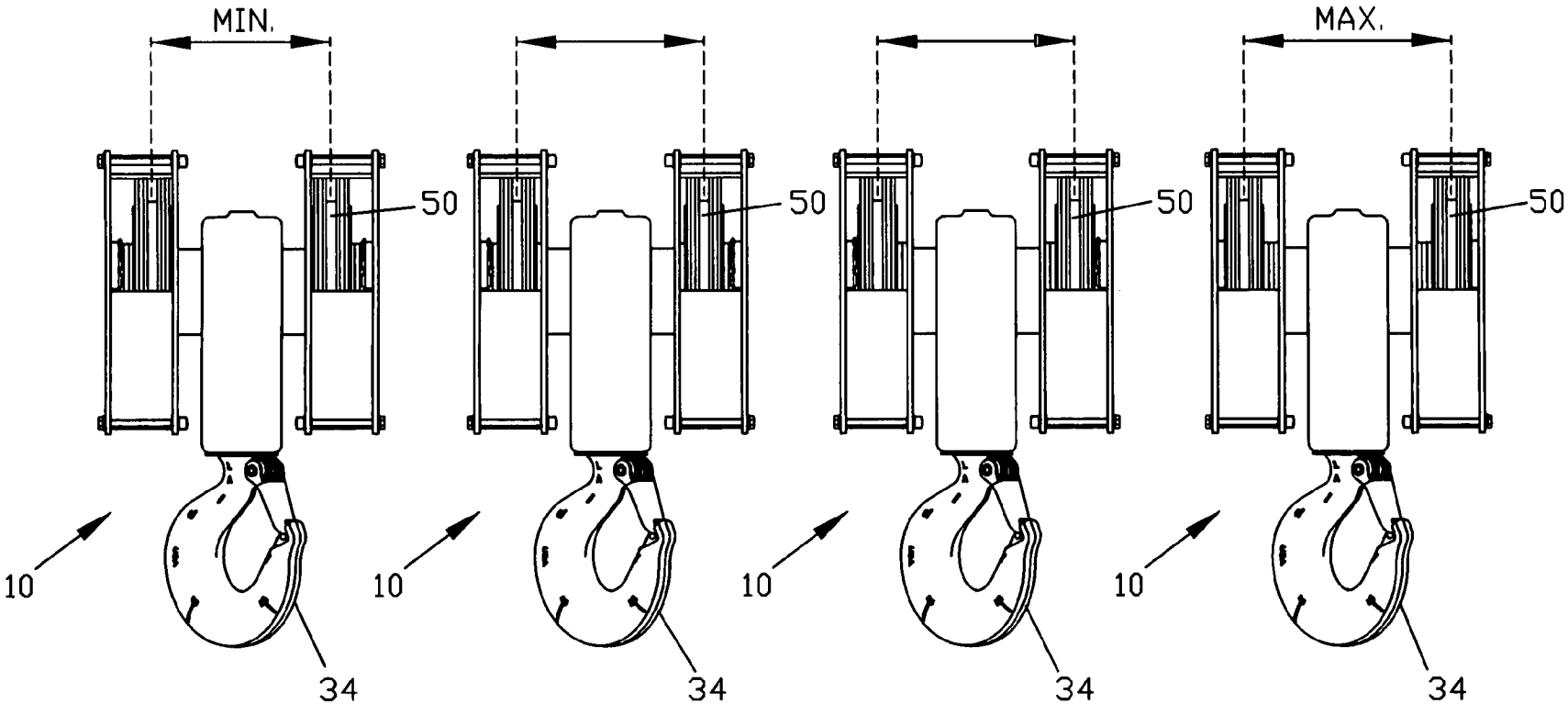
FIGS. 7, 8, 9 and 10 illustrate assembled views of the arrangements shown in FIGS. 3 through 6.

FIG. 7 illustrates the assembled block 10 shown in FIG. 3, which provides the minimum sheave spacing. FIG. 8 illustrates the assembled block shown in FIG. 4 and FIG. 9 illustrates the assembled block shown in FIG. 5. Finally, FIG. 10 illustrates the assembled block 10 shown in FIG. 6 which provides the maximum sheave spacing. From the foregoing, it will be appreciated that the lateral spacing of the sheaves may be adjusted by placement of the spacers.

Whereas, the present invention has been described in relation to the drawings attached hereto, it should be understood that other and further modifications, apart from those shown or suggested herein, may be made within the spirit and scope of this invention.

What is claimed is:

1. A field adjustable block for use with a bridge crane having a rotating cylindrical drum for rope, which block comprises:

a cylindrical center pin having a key way recess parallel to an axis of said center pin;

an inner side plate having an opening therethrough and an extending key receivable in said key way recess;

multiple sheaves, each receivable over said center pin;

at least one toroidal spacer receivable over said center pin;

a lock washer for an end of said center pin, said lock washer having a key receivable in said key way recess and a plurality of radially extending tabs; and a nut having at least one notch to receive one of said extending tabs.

2. A field adjustable block as set forth in claim 1 including an outer side plate removably attached to said inner side plate by fasteners.

3. A field adjustable block as set forth in claim 1 having a pair of said inner side plates, at least two of said sheaves, a pair of lock washers, and a pair of nuts.

4. A field adjustable block as set forth in claim 1 including a fitting suspended from said center pin.

5. A field adjustable block as set forth in claim 4 wherein said fitting is a hook.

6. A field adjustable block as set forth in claim 4 wherein said fitting is a shackle.

7. A field adjustable block as set forth in claim 4 wherein said fitting is a ring.

8. A field adjustable block as set forth in claim 4 wherein said fitting is an eyebolt.

9. A field adjustable block as set forth in claim 1 including a bearing juxtaposed between each said sheave and said center pin.

10. A field adjustable block as set forth in claim 1 including a plurality of spacers.

11. A field adjustable block as set forth in claim 1 wherein said center pin is replaceable with a center pin of alternate length.

12. A process to install a field adjustable block for use with a bridge crane, which process comprises:

installing an inner side plate having an extending key over a cylindrical center pin having a key way recess;

installing a sheave over said center pin;

installing at least one toroidal spacer prior to or after installing said sheave for a selected location of said sheave;

installing a lock washer having an inwardly extending key over said center pin so the key is receivable in said key way recess and having a plurality of radially extending tabs; and securing a nut to said center pin wherein said nut includes at least one notch to receive one of said tabs from said lock washer.

13. A process as set forth in claim 12 including the additional step of attaching an outer side plate to said inner side plate with removable fasteners.

14. A process as set forth in claim 12 including suspending a fitting from said center pin.

* * * * *